United States Patent [19]

Akiyama et al.

[11] 4,419,173

[45] Dec. 6, 1983

[54] METHOD OF PRODUCING CORRUGATED CARDBOARDS AND APPARATUS

[75] Inventors: Toshimitsu Akiyama; Tadashi Kasamatsu, both of Tokyo, Japan

[73] Assignee: K-Three Products Kabushiki Kaisha, Tokyo, Japan

[21] Appl. No.: 285,804

[22] Filed: Jul. 22, 1981

[30] Foreign Application Priority Data

Jul. 22, 1980 [JP] Japan ..... 55/100088

[51] Int. Cl.[3] ..... B31F 1/20

[52] U.S. Cl. ..... 156/470; 156/551; 156/208; 156/210; 156/324; 34/47; 34/155; 127/28; 239/139

[58] Field of Search ..... 156/205, 210, 208, 292, 156/308.8, 318, 319, 324, 336, 470, 497, 549, 551, 578; 428/182, 186, 184; 34/30, 47, 155, 233; 239/128, 129, 136, 137, 139, 135; 127/28

[56] References Cited

U.S. PATENT DOCUMENTS

| | | | |
|---|---|---|---|
| 2,602,877 | 7/1952 | Dawson | 239/135 |
| 3,319,353 | 5/1967 | Matsunami et al. | 34/155 |
| 3,340,125 | 9/1967 | Drenning et al. | 156/285 |
| 3,386,659 | 6/1968 | Rea | 239/135 |
| 3,434,901 | 3/1969 | Griffiths et al. | 156/470 |
| 3,690,981 | 9/1972 | Frank et al. | 156/210 |
| 3,945,570 | 3/1976 | Dove | 239/139 |
| 4,114,022 | 9/1978 | Braulke | 239/137 |
| 4,266,116 | 5/1981 | Bauer et al. | 239/136 |

FOREIGN PATENT DOCUMENTS

| | | | |
|---|---|---|---|
| 48-19714 | 8/1973 | Japan | 34/30 |

*Primary Examiner*—Edward C. Kimlin
*Assistant Examiner*—F. K. Wine
*Attorney, Agent, or Firm*—Armstrong, Nikaido, Marmelstein & Kubovcik

[57] ABSTRACT

Disclosed is an improved method of producing corrugated cardboards, in which water suspension of raw starch is used as an adhesive. The raw starch is, after application thereof, heated to form gell or paste with dry steam prepared by reheating low-pressure steam with high-pressure steam. Also, disclosed is an apparatus for practicing the improved method.

6 Claims, 10 Drawing Figures

METHOD OF PRODUCING CORRUGATED CARDBOARDS AND APPARATUS

BACKGROUND OF THE INVENTION

1. Field of the Invention

The present invention relates to an improved method of producing corrugated cardboads, and encompasses an apparatus for practicing the method.

2. State of the Art

As well known, corrugated cardboards are produced by the steps of adhering a sheet of corrugated paper with a sheet of liner to form a half-lined corrugated paper, and then, adhering another sheet of liner thereto. In some cases, two or more sheets of the half-lined corrugated paper are used to produce a "double-backer" or thicker ones.

As far as adhesive effect is concerned, synthetic resin-based adhesives such as emulsion of poly vinyl acetate are preferable. However, from the view to reduce the producing cost of corrugated cardboard, efforts has been made to use less expensive pasty materials. One of the successful ways is to use raw or uncoocked starch, i.e. water suspension of starch particles (hereinafter referred to as "raw starch"). The raw starch is coated on the corrugated paper, and then a liner is pressed to the coated corrugated paper under heating, thereby to cause gellation of the starch and transform it to a paste. To apply heat under pressure, it is generally practiced that the liner is contacted and slided on arranged series of "hot plates", or metal plates which supply heat.

Arrangement of the hot plates requires considerable floor area for the corrugated cardboard producing machine. The hot plates consume much heat energy, and moreover, it is often experienced that product cardboards suffer from scratches and (or) warp. It has been proposed, with the intention of eliminating use of the hot plates, that the raw starch coated on the corrugated paper so as to cause gellation thereof prior to contacting with the liner (Japanese Patent Publication No. 24658/1972).

The method got good reputation as far as elimination of the hot plate is concerned. However, practical use revealed a disadvantage of low productivity due to limited line speed on machine. It has been generally practiced in gellation of raw starch to blow steam out of nozzles to heat the raw starch coated on the projecting portion of the corrugated paper. In order to increase line speed on machine, it is effective to provide sufficient heat to the raw starch so as to increase rate of gellation. Low-pressure (say, 0.2 kg/cm$^2$ gauge) steam usually used has a temperature as low as 80° to 85° C. when blown out of the nozzles, and therefore, has insufficient thermal energy. To realize a higher heating temperature, we tried use of high-pressure steam. It was experienced that the blowing is too vigorous and sweeps off the coated raw starch, thus causing dissatisfactory adhesion. Supply of too much steam resulted in excessive moistening of the half-lined corrugated paper with water formed by condensation of the steam. Though the scratching and (or) warp caused by use of the hot plates are avoided, excessive moistening causes another problem of longer necessary time for drying the product and reduction of the increased line speed on machine. (If the corrugated cardboard still moistened is processed in carton-making step, product cartons will have inaccurate size and insufficient strength.)

Further, according to our experience, it will give better adhesion to incompletely gell the raw starch before application of pressure and to complete the gellation by additional heating at and after the application of pressure, then to completely gell the raw starch before the application of pressure as practiced in the above mentioned prior method. It is believed that this is due to better infiltration of the incompletely gelled starch into the structure of the mating liner. Thus, the technology disclosed in the above noted Japanese Patent Publication No. 24658/1972 could be practiced better with partial use of the conventional hot plates.

SUMMARY OF THE INVENTION

An object of the present invention is to provide an improved method of producing corrugated carboards, which solves the above noted problems due to insufficient heat of gelling the raw starch into an adhesive, in either case of complete gellation with steam or a case of incomplete gellation followed by the additional heating with the hot plates.

In other words, an aim of this invention is to enable high-speed production of corrugated cardboard with keeping quality of the product high. Another aim is to realize production with reduced energy consumption in case where increase of producing rate is not required.

Another object of the present invention is to provide an apparatus for carrying out the above method of producing corrugated cardboards.

DRAWINGS

FIG. 2A being a plan view partially broken away, FIG. 2B being a cross-sectional view, and FIG. 2C being a side view partially broken away;

FIG. 4A being longitudinal section, and FIG. 4B being cross section;

FIG. 6 showing the case of heating with hot plates only according to the conventional technology, and FIG. 7 showing the case of heating according to the present invention with additional heating with the hot plates.

DETAILED EXPLANATION OF PREFERRED EMBODIMENTS

The characteristic feature of the present invention for achieving the above mentioned objects is to use low-pressure steam which is reheated to be dry steam and blown out of nozzles to heat the raw starch. Suitable low-pressure steam has a pressure of 0.1 to 0.3 kg/cm$^2$ gauge, usually around 0.2 kg/cm$^2$ gauge.

Temperature of the low-pressure steam will easily increase by being reheated to 105° to 130° C. at the outside the nozzles. Use of the dry steam of this temperature range, it is possible to gell the raw starch without vigorous blowing of the steam and excess moistening of the corrugated paper.

The above objects will be further achieved in accordance with a preferred embodiment of the present method by mixing steam with air and reheating the mixture for use. Though the mixing ratio of the steam can vary widely, it is generally preferable to use a mixture consisting of a major amount of steam and a minor amount of air. If the steam is in a too small amount, a dry skin will form at the surface of the paste formed by gellation of the raw starch, and impairs adhesion. Suitable amount of water to be given to the corrugated paper at the heating by the steam/air mixture may vary depending on some factors, for example, humidity of the environment. So, the mixing ratio should be chosen, taking these factors in account, from the view to ensure the adhesion with the paste and to result a suitable amount of water in the product.

Even in cases of using steam/air mixture, pressure of the steam is preferably 0.1 to 0.3 kg/cm$^2$ gauge, usually around 0.2 kg/cm$^2$ gauge. Reheating of the mixture will easily increase the temperature to 110° to 130° C. which is sufficient to give necessary heat to the raw starch.

Reheating of the steam or steam/air mixture can be performed by any means, e.g., electrical heating. However, it is advantageous to utilize heat retained in high-pressure steam, if available, through thermal exchange, namely, by indirect heating of the low-pressure steam with the high-pressure steam prior to decreasing the pressure of the latter. In case where a very wet steam is used, the reheating may be carried out by mixing steam with air which is previously heated to a suitable high temperature so that the mixture may be to a suitable temperature, if sufficient mixing can be done. "Reheating the steam/air mixture" in the present invention includes such an embodiment.

According to the above described present method, it is easy to realize improvement of productivity, for example, 20 to 30% increase of line-speed on machine for production of a double-backer corrugated cardboard.

Figure 1:
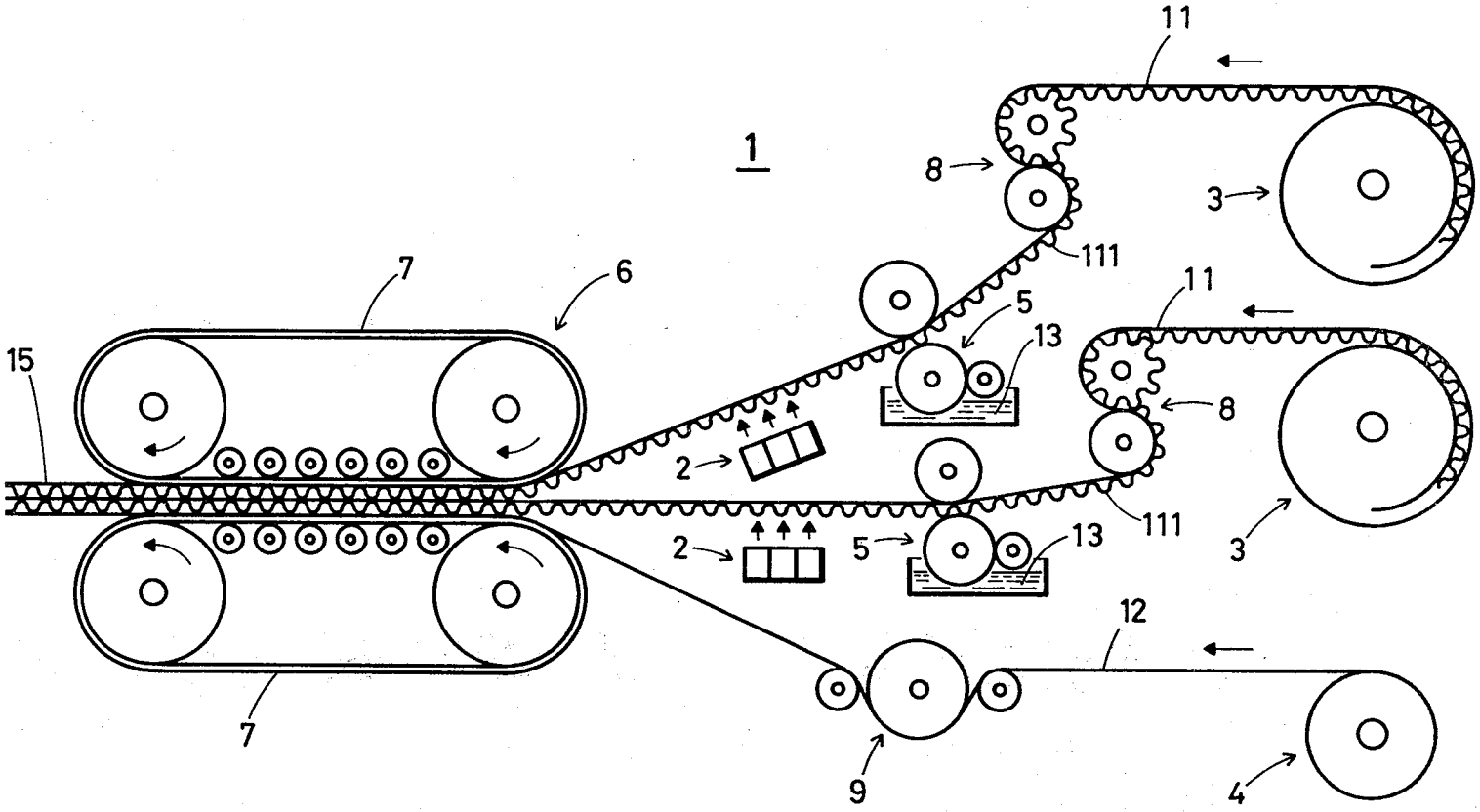
FIG. 1 is a schematic side view of the present apparatus for producing a double-backer corrugated cardboard.
Figure 2A:
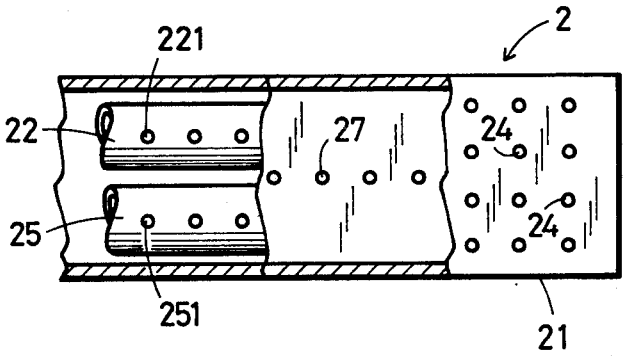
FIGS. 2A, 2B and 2C show an examplification of the means for blowing steam in FIG. 1.
Figure 2B:
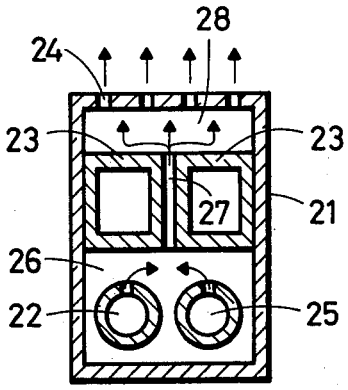
Figure 2C:
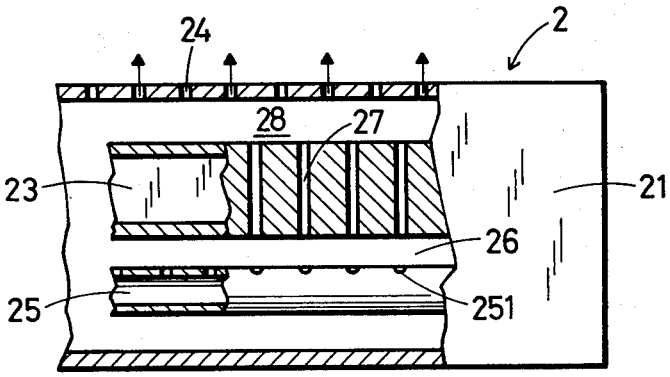

An apparatus suitable for practicing the present method will be illustrated below:

As typically shown in FIG. 1 and FIG. 2, the apparatus 1 for producing corrugated cardboards according to the present invention essentially comprises means for continuously feeding 3 at least one sheet (in the Figure, two sheets) of half-lined corrugated cardboard 11, means for continuously feeding 4 one sheet of liner 12, means for coating 5 projecting portions 111 of the corrugated paper 11 with water suspension of raw starch 13, means for blowing steam 2 to the coated raw starch so as to gell it and form paste, means for applying pressure 6 to the above at least one sheet of half-lined corrugated cardboard 11 and one sheet of liner 12 so as to adhere them to form corrugated cardboard 15, and means for continuously tracting 7 thus formed corrugated cardboard, and is characterized in that the means for blowing steam 2 comprises a pipe 22 for feeding low-pressure steam, reheater 23 for heating the steam fed, and nozzles 24 for blowing out the reheated steam. In FIG. 1, numerical references 8 and 9 indicate preheaters for the half-lined corrugated paper and the liner, respectively.

Details of an example of the means for blowing steam 2, which is the characteristic component of the present apparatus, is shown in FIG. 2. This example is a preferred one, in which pipes for conducting the high-pressure steam installed in the passageway of the low-pressure steam is utilized as the reheater of the low-pressure steam, and means for introducing air for mixing with the steam is included. As seen in FIG. 2, the means for blowing steam 2 is constructed in a case 21 of a square tube, which has multiple nozzles 24 at the upper face thereof, and in which combined pipes 23 and 23 for the high-pressure steam divide the inside into header 28 of the upper part and mixing chamber 26 of the lower part. The mixing chamber 26 and the header 28 are connected with passages for the steam/air mixture 27 which are located between the pipes 23 and 23 for the high-pressure steam. In the mixing chamber 26, pipe 25 for feeding air is installed in parallel position to the pipe for the low-pressure steam.

The low-pressure steam and the air fed through pipe 22 and 25, respectively, under control of flow rates thereof by controlling valves, passes through nozzles 221 and 251 into the mixing chamber 26 with a suitable volume ratio. The mixture formed in the mixing chamber pass the passage 27 and is heated by the high-pressure steam flowing through the pipes 23 and 23 to reach a desired temperature, and by way of the header 28, blows out of the nozzles 24.

Figure 3:
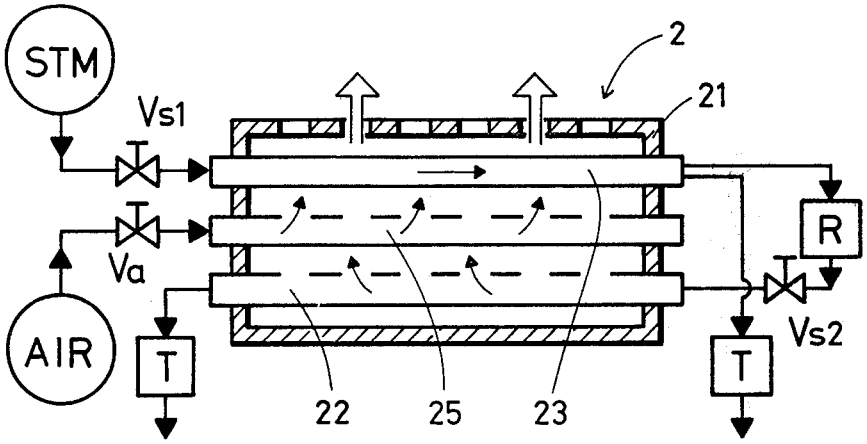
FIG. 3 is a schematic diagram illustrating construction of the means for reheating-blowing of a mixture of steam and air used in the present apparatus.

In case where it is intended to utilize the heat retained in high-pressure steam prior to decrease of pressure thereof, the embodiment shown in FIG. 3 is recommended. According to this embodiment, high-pressure steam from the source STM pass through pipe 23 by way of valve $Vs_1$, and, after heat-exchange, becomes low-pressure steam at pressure reducing valve R. The low-pressure steam, by way of valve $Vs_2$, comes out of nozzles of pipe 22, which steam is mixed with air from source of compressed air AIR coming out of nozzles of pipe 25 by way of valve Va. In the Figure, "T" indicates a steam trap.

It is convenient to equip the apparatus with two to three or more of the above described means for blowing steam, and to use some or all of them depending upon the necessity. Generally speaking, when it is intended to carry out high speed production, much more heat is required to gel the raw starch, and therefore, many of the steam blowing means should be operated.

Figure 4A:
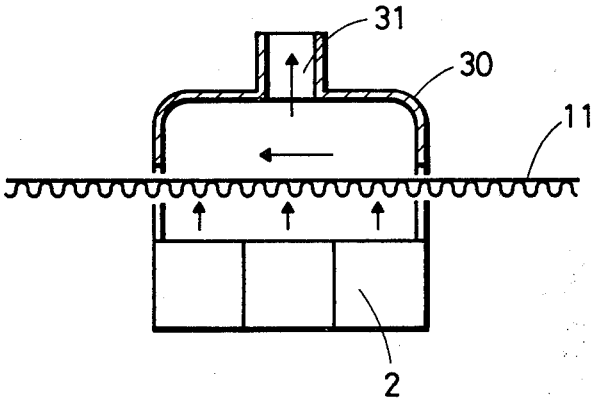
FIGS. 4A and 4B show a preferred embodiment of the present apparatus which uses a hood at the zone where steam is blown.
Figure 4B:
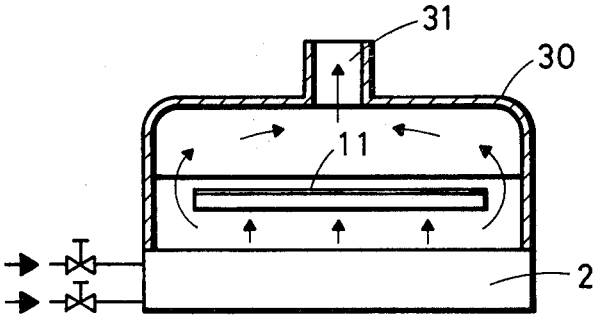

In order to ensure the effect of giving heat energy sufficient to gell the raw starch, it is recommended to use a thermal hood 30 as shown in FIGS. 4A and 4B. The hood is installed at the location to cover the opposite zone to the steam blowing means 2 with the half-lined corrugated paper between them, and extends beyond both side of the half-lined corrugated paper as shown in the Figure. It also has a draught hole 31 at the upper part thereof. Use of the hood causes circulation of steam as indicated with arrows in the Figure so that the gellation may occur rapidly and uniformly without substantial temperature difference between the center and the both side of the half-lined corrugated paper.

Figure 5:
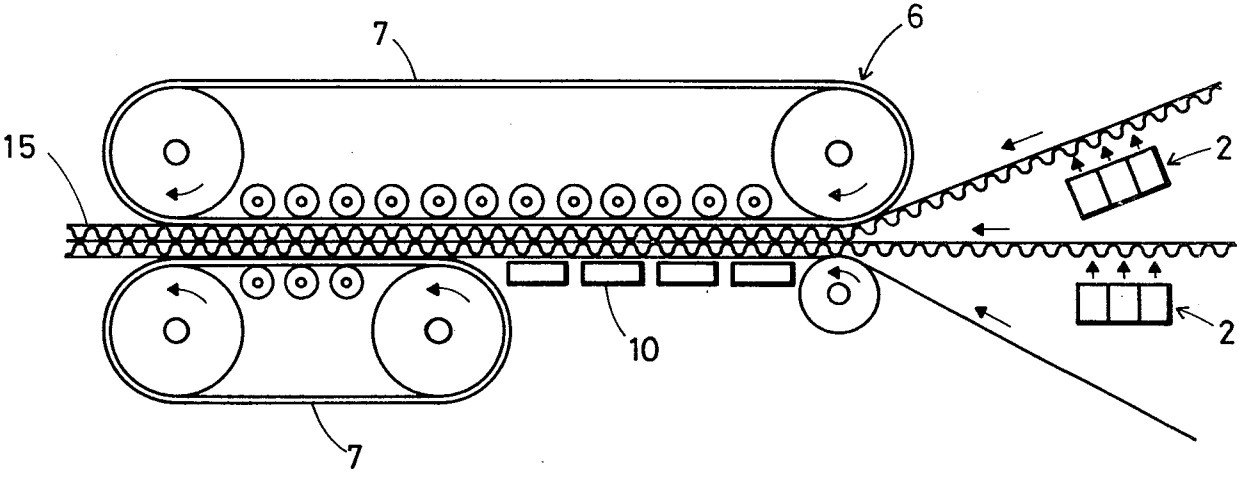
FIG. 5 show another embodiment of the present apparatus, corresponding to a part of FIG. 1.

Further, in case where it is intended to use the above mentioned additional heating with the hot plates, the present apparatus should have altered part for application of pressure and adhesion. That is the change of the left-hand part of FIG. 1 to the part shown in FIG. 5. In this Figure, numerical reference 10 indicates the hot plates.

Various modifications are possible in the present apparatus. For example, there may be different embodiments of the means for blowing steam 2 other than the embodiment shown in FIG. 2 having the same performance. Also, the means 2 may be equipped with rack-and-pinion driven by an electric motor so as to move the means up and down for maintenance of the apparatus, particularly, for cleaning of vessel for the raw starch and coating roll. Other addition and modification could be easily made by those skilled in the art.

COMPARATIVE EXAMPLE AND EXAMPLE

A double-backer corrugated cardboard consisting of the right side liner, the reverse side liner, center liner and two sheets of corrugated paper therebetween was produced to have the construction of K6×S×K6. The materials used are, "K-liner" 210 g/m$^2$ for the right side-and reverse side liners (k6), and "SCP" 125 g/m$^2$ for the sheets of corrugated paper of layers A and B, and the center liner.

Firstly, producing was carried out using a conventional machine having only hot plates as the means for heating the raw starch, and temperatures at various points prior to and during application of pressure.

Figure 6:
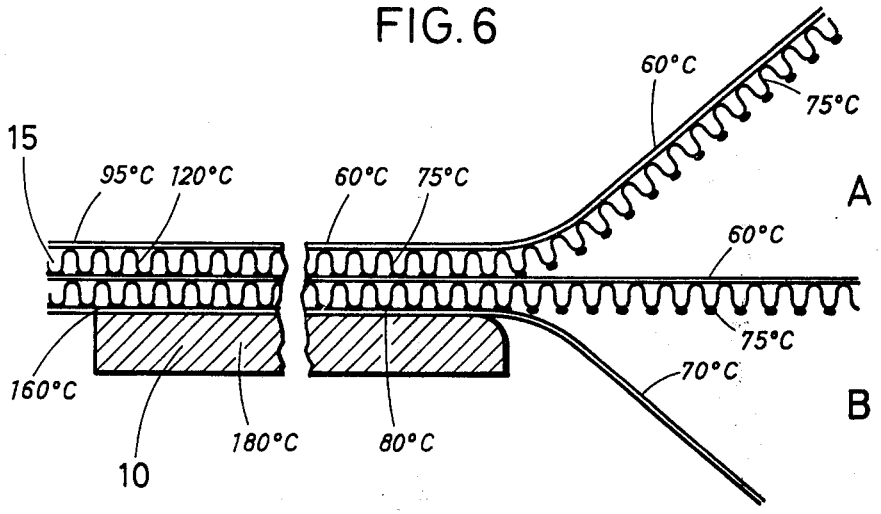
FIG. 6 and FIG. 7 show temperature distribution at a steady state of practical production of a double backer corrugated cardboard.

The measured temperatures are shown in FIG. 6. The corrugated paper of layer A receives heat from preheating rolls to be 75° C., but the raw starch coated on the projecting portions of the corrugated paper is of a lower temperature. For this reason, the hot plates extending over 10 m are necessary to completely gell the raw starch into paste, to adhere and to dry the paste. The line speed on machine was recorded to be 120 to 125 m/min.

Then, producing in accordance with the present invention was conducted using the apparatus as shown in the Figures with additional heating with the hot plates. No steam was blown to layer B.

Figure 7:
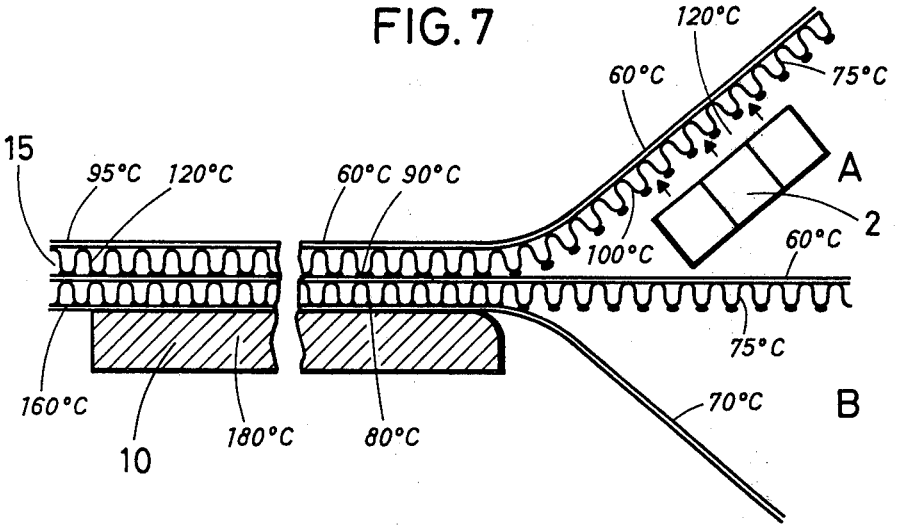

Temperatures measured at the various points are as shown in FIG. 7. Blowing steam (mixed with air) of about 120° C. increased the temperature of the raw starch coated on layer A to 90° C. at the time of applying pressure, and gellation reached to the extent of 50 to 70%. The line speed on machine in this run was improved to be 160 to 170 m/min.

On the other hand, necessary length of the hot plate zone was decreased to 6 meters with the same producing speed as that of the conventional technology.

What is claimed is:

1. In an apparatus for producing corrugated cardboards essentially comprising means for continuously feeding at least one half-lined corrugated paper and one liner, means for coating projecting portions of the corrugated paper with a water-suspension of raw starch, means for blowing steam on the coated raw starch suspension to cause gellation thereof, means for applying pressure to the half-lined corrugated paper sheet and the liner so as to adhere them to form a corrugated cardboard, and means for continuously receiving the thus formed corrugated cardboard, an improvement characterized in that the means for blowing steam comprises a pipe for feeding low pressure steam, a tubular body lying near the half-lined corrugated paper sheet across the moving direction of the sheet, the tubular body having multiple nozzles for blowing reheated steam at the upper surfaces of the sheet, a reheater of the feed steam being located inside the tubular body and having pipes as passages for high pressure steam, the pipes dividing the tubular body into an upper header and a lower mixing chamber, the pipe for the low pressure steam and a pipe for air to be mixed with the low pressure steam being positioned in the lower mixing chamber, and a pathway for the mixture connecting the lower mixing chamber and the upper header.

2. An apparatus for producing corrugated cardboards according to claim 1, wherein the apparatus further comprises hot plate means for heating another liner which is pressed and is in contact with the at least one half-lined corrugated paper.

3. An apparatus for producing corrugated cardboards according to claim 2, wherein the apparatus has plural means for blowing steam, and, as occasion demands, one or more of the means are used.

4. An apparatus for producing corrugated cardboards according to claim 1, wherein the apparatus is equipped with a warming hood covering the area opposite to the means for blowing steam, extending beyond the both sides of the half-lined corrugated paper sheet, and having a draught hole at the upper part thereof.

5. An apparatus for producing corrugated cardboard essentially comprising means for continuously feeding at least one half-lined corrugated paper and one liner, means for coating projected portions of the corrugated paper with a water-suspension of raw starch, means for blowing steam on the coated raw starch suspension to cause gellation thereof, means for applying pressure to the half-lined corrugated paper sheet and liner so as to adhere them to form a corrugated cardboard, and means for continuously receiving the thus formed corrugated cardboard, an improvement characterized in that the means for blowing steam comprises a tubular body lying near the half-lined corrugated paper sheet across the moving direction of the sheet having multiple nozzles for blowing reheated steam at the upper surface of the sheet, a pipe with nozzles for supplying air, and a reheater of feed steam having a pipe for high-pressure steam connected through a pressure-reducing valve to a pipe with nozzles for feeding low-pressure steam, so that high-pressure steam passes through the high-pressure steam pipe, and then through the pressure-reducing valve; thereby, providing low-pressure steam for the low-pressure steam pipe.

6. An apparatus for producing corrugated cardboards according to claim 5, wherein the pipe for the reheater of steam is installed in a passage way of the feed steam.

* * * * *